United States Patent [19]

Dick et al.

[11] 3,966,343

[45] June 29, 1976

[54] STRIP PAVING MACHINE

[75] Inventors: Perry J. Dick; Perry J. Dick, Jr., both of Pittsburgh, Pa.

[73] Assignee: Trumbull Corporation, Pittsburgh, Pa.

[22] Filed: Dec. 16, 1974

[21] Appl. No.: 532,772

[52] U.S. Cl. ..... 404/101; 61/63

[51] Int. Cl.[2] ..... E01C 19/12

[58] Field of Search ..... 404/83, 84, 96, 97, 404/98, 101, 102, 108, 118, 119, 104, 105, 106, 109, 110, 120; 61/63

[56] References Cited

UNITED STATES PATENTS

| | | | |
|---|---|---|---|
| 2,090,959 | 8/1937 | Jackson | 61/63 |
| 2,094,974 | 10/1937 | Wood | 61/63 |
| 2,170,330 | 8/1939 | Joedicke | 61/63 |
| 2,598,903 | 6/1952 | Gebhard | 61/63 |
| 2,827,771 | 3/1958 | Baer | 61/63 |
| 3,177,784 | 4/1965 | Retzlaff | 404/108 |
| 3,182,460 | 5/1965 | Durston | 61/63 |
| 3,228,311 | 1/1966 | Mengel | 404/101 |
| 3,318,208 | 5/1967 | Durston | 404/102 |
| 3,342,035 | 9/1967 | Sale | 404/108 X |

*Primary Examiner*—Nile C. Byers

*Attorney, Agent, or Firm*—Stanley J. Price, Jr.; John M. Adams

[57] ABSTRACT

A strip paving machine for forming step-like breakers on the inclined surfaces of a diversion island for a power plant cooling pond includes a mobile receiving hopper that is propelled by a bulldozer over the floor of the cooling pond. A forwardly advancing dump truck remains in material receiving relationship with the front end portion of the receiving hopper and deposits castable material onto a conveyor that is transversely positioned in the receiving hopper. The material is transported laterally out of the receiving hopper onto a bridge conveyor that is pivotally connected at one end to the receiving hopper. The upper end portion of the bridge conveyor is slidably supported on the inclined surface of the diversion island and is pivotally connected to a mobile feed hopper. The feed hopper is forwardly propelled on the diversion island by a prime mover at the rate of speed of the receiving hopper. The castable material is deposited into the feed hopper and spread upon the surface of the diversion island by an extruding device in a strip having the configuration of three inclined steps that form the breakers on the diversion island. Vibrating beams supported rearwardly of the feed hopper compact the step-like breakers after they are cast by the extruding device. By continuously feeding the castable material from the receiving hopper to the feed hopper as the feed hopper traverses the inclined surfaces of the diversion island, the surfaces are paved in strips that serve to break up the wave action within the cooling pond.

12 Claims, 6 Drawing Figures

STRIP PAVING MACHINE

BACKGROUND OF THE INVENTION

1. Field of the Invention

This invention relates to a paving machine and more particularly to a paving machine that covers the sloping surfaces of a diversion island for a power plant cooling pond with a continuous surface having a step-like configuration.

2. Description of the Prior Art

In cooling ponds for power plants the hot water discharged from the power plant is directed around a diversion island that separates the outlet of the power plant from the inlet. The diversion island directs the water a sufficient distance from the outlet to the inlet to permit the water to cool before it enters the inlet of the power plant. The diversion island is an earthen structure having surfaces that slope downwardly from a central peak that divides the inlet from the outlet. With this arrangement, the hot water is cooled as it circulates around the diversion island.

One problem that is encountered in the cooling of the water by this method is the generation of waves within the cooling pond under high wind conditions that divert the water over the diversion island. Subsequently, the hot water is directed from the outlet under the wave action over the diversion island into the portion of the cooling pond adjacent the inlet of the power plant. Consequently, the water does not circulate a sufficient distance to cool and, therefore, heated water is taken into the power plant. The wave problem is intensified by the smooth surfaces of the diversion island which present little or no resistance to the waves as they flow over the top of the diversion island. In addition, the wave action erodes the earthen diversion island and thereby diminishes the slope of the island.

To eliminate the interruption of the cooling process and the erosion problem generated by the wave action, the surface of the diversion island is paved in steps that extend longitudinally on the surface of the island. The steps serve to break up the wave action to thus prevent the hot water from flowing over the island and also to prevent erosion of the island. The known methods of constructing the step-like surface on the slopes of the diversion island require considerable effort and expenditure. First, forms for the step-like breakers must be constructed on the diversion island, and then castable material, such as concrete or an admixture of soil and cement, is poured into the forms. Upon curing, the step-like breakers are formed. Another alternative to erecting step-like breakers on the diversion island is precasting the breakers and then laying the precast breakers in strips upon the surface of the diversion island.

Paving devices in general are well known in the art, and particularly machines for paving canal linings as disclosed in U.S. Pat. No. 2,090,959, in which a method and apparatus is described for lining the inclined walls of canal with a uniform surface of concrete. An inclined frame is supported for movement parallel to the canal and includes a carriage that is movable on the frame above the surface to be paved. A screed is mounted on the carriage and is provided with a vibrator, which feeds the castable material such as concrete from a hopper. In this manner, a planar lining of concrete is applied to the inclined surface of the canal.

U.S. Pat. Nos. 2,707,422, 2,818,790, 3,427,938 and 3,710,695 disclose curbing machines that utilize a screw conveyor to transport concrete from a supply hopper to a distributing hopper. The distributing hopper then directs the concrete to its curved extruding shoe. U.S. Pat. No. 3,710,695 includes an elevating screw conveyor that is mounted on crawler tractors. The tractors include a linkage mechanism for compensating for deviations in the slope of the grade to be paved.

In addition, U.S. Pat. Nos. 3,225,668 and 3,107,592 describe machines for distributing concrete within forms that define a roadway to be paved. A pivotal conveyor transports concrete from a mixer into the roadway form. U.S. Pat. No. 3,693,512 illustrates and describes an elevating conveyor that lifts paving material from a hopper and conveys it to a discharge point. At the discharge point excess material is stored until it can be distributed by a paving machine.

There is need for a paving machine that continuously applies and casts material on the inclined surfaces of a power plant diversion island without the necessity of interrupting the process of applying the material onto the surface and of casting the material in a preselected configuration.

SUMMARY OF THE INVENTION

In accordance with the present invention, there is provided a paving machine for paving a sloped surface with a castable material in strips having a preselected configuration that includes a mobile receiving hopper for continuously receiving the castable material. A prime mover forwardly propels the receiving hopper at a selected rate of speed. The receiving hopper has an outlet for discharging the castable material at a controlled rate as it is being forwardly propelled by the prime mover. A conveyor is connected to the receiving hopper and includes a material receiving end portion connected to the receiving hopper outlet. The conveyor transports the castable material laterally from the receiving hopper to a discharge end portion. The conveyor is supported by a bridge frame that is positioned transversely relative to the direction of travel of the receiving hopper. The conveyor support frame maintains the conveyor discharge end portion at a preselected elevation above the conveyor receiving end portion on the slope being paved. A feed hopper is secured to and positioned below the conveyor discharge end portion for continuously receiving the castable material from the conveyor. An extruding device is provided at the lower portion of the feed hopper to spread the castable material onto the surface of the slope in a strip having a preselected configuration. Vibrating mechanisms are secured to the rearward end portion of the feed hopper and are operable to compact the formed strips after they are cast by the extruding device. The feed hopper is forwardly propelled by a prime mover at the rate of speed of the receiving hopper so that the conveyor remains transverse to the direction of travel of the feed hopper and the receiving hopper.

A forwardly advancing dump truck containing the castable material is maintained in material receiving relationship with the open end portion of the receiving hopper conveyor and deposits the castable material into a receiving bin of the receiving hopper. A receiving conveyor extends transversely across the bottom of the receiving bin to transport the castable material from the receiving hopper onto the conveyor. The conveyor support frame is pivotally connected to an extension of the receiving hopper so that the receiving conveyor and the bridge conveyor remain axially aligned.

The castable material is deposited from the discharge end portion of the conveyor into the feed hopper through a funnel that is pivotally connected to the top of the feed hopper by a turntable. With this arrangement, the feed hopper may be turned 180 degress below the conveyor support frame for positioning the feed hopper to pave the slope in the opposite direction.

The feed hopper has an open bottom portion and an opening in one of the sidewalls through which the castable material flows onto the sloped surface. The opening is partially obstructed by the extruding device having a shaped configuration such as the configuration of three inclined steps to be formed with a single pass of the paving machine on the slope. The extruding device also includes a vibrator that oscillates the extruding device at high frequency to aid in the discharge of the castable material from the feed hopper.

The vibrating mechanism that is positioned rearwardly of the feed hopper includes a pair of parallel spaced beam members each having a lower surface with the configuration of the extruding device. The beam members are provided with a motor driven vibrator that oscillates the beam members to urge the shaped lower surfaces into and out of contact with the formed steps. In this manner, the steps are compacted after they are cast by the extruding device.

Accordingly, the principal object of the present invention is to provide a strip paving machine for continuously casting strips of step-like breakers upon the sloped surfaces of the diversion island of a power plant cooling pond.

Another object of the present invention is to provide a paving machine that permits continuous feeding of castable material from a receiving hopper to a feed hopper that discharges the castable material through an extruding device that applies the material onto a surface in a desired configuration as the feed hopper and the receiving hopper are forwardly advanced.

Still another object of the present invention is to provide a paving machine that includes an elevated bridge conveyor connected at its end portions to a receiving hopper and a feed hopper which are both advanced at the same rate of speed to permit the simultaneous feeding and casting of castable material in strips having a desired configuration onto a sloped surface.

These and other objects of the present invention will be more completely described in the following specification, the accompanying drawings and the appended claims.

DESCRIPTION OF THE PREFERRED EMBODIMENTS

Figure 1:
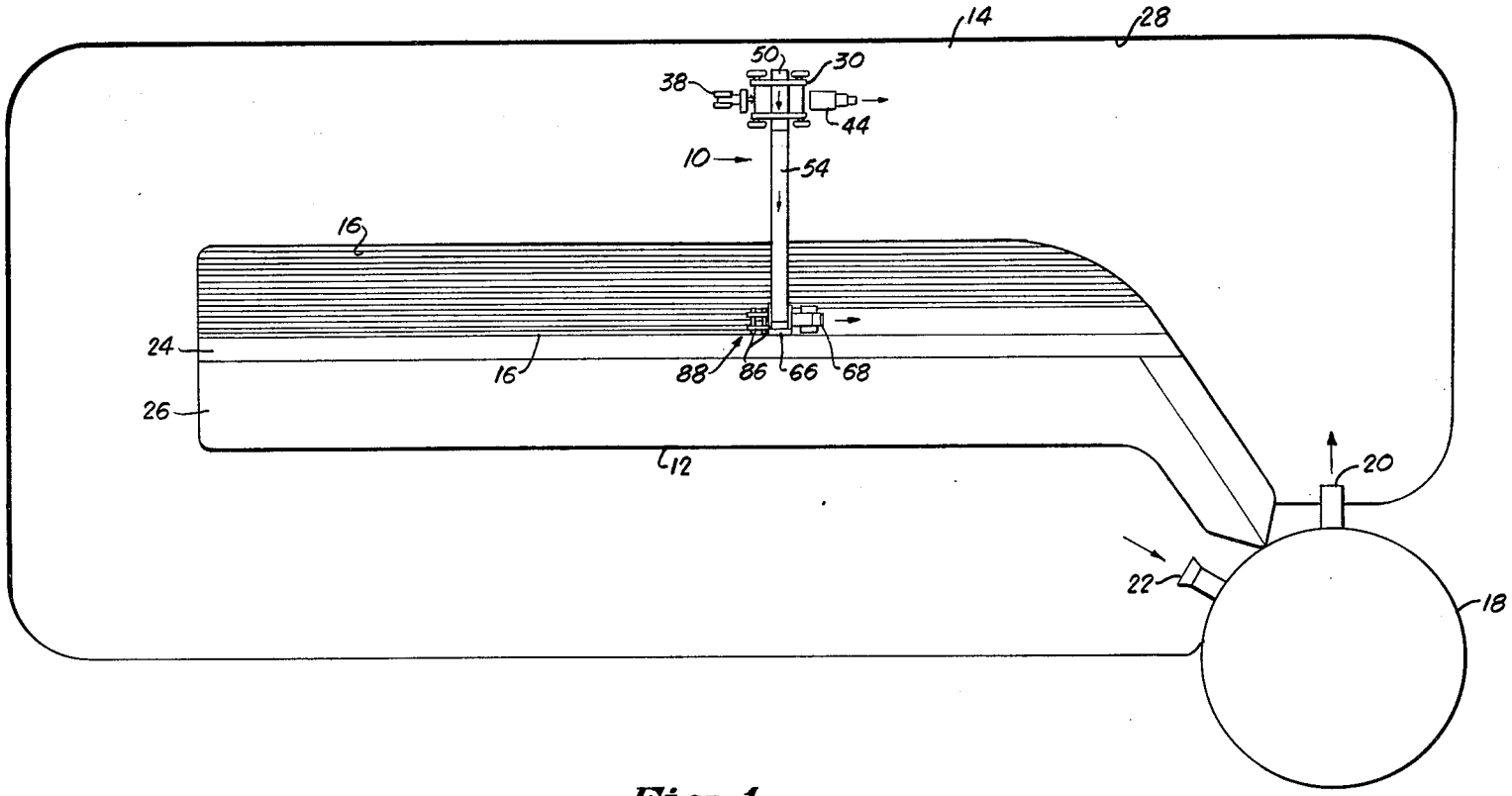
FIG. 1 is a schematic representation in plan view of the strip paving machine, illustrating operation of the machine to pave the inclined surfaces of the diversion island of a power plant cooling pond.
Figure 2:
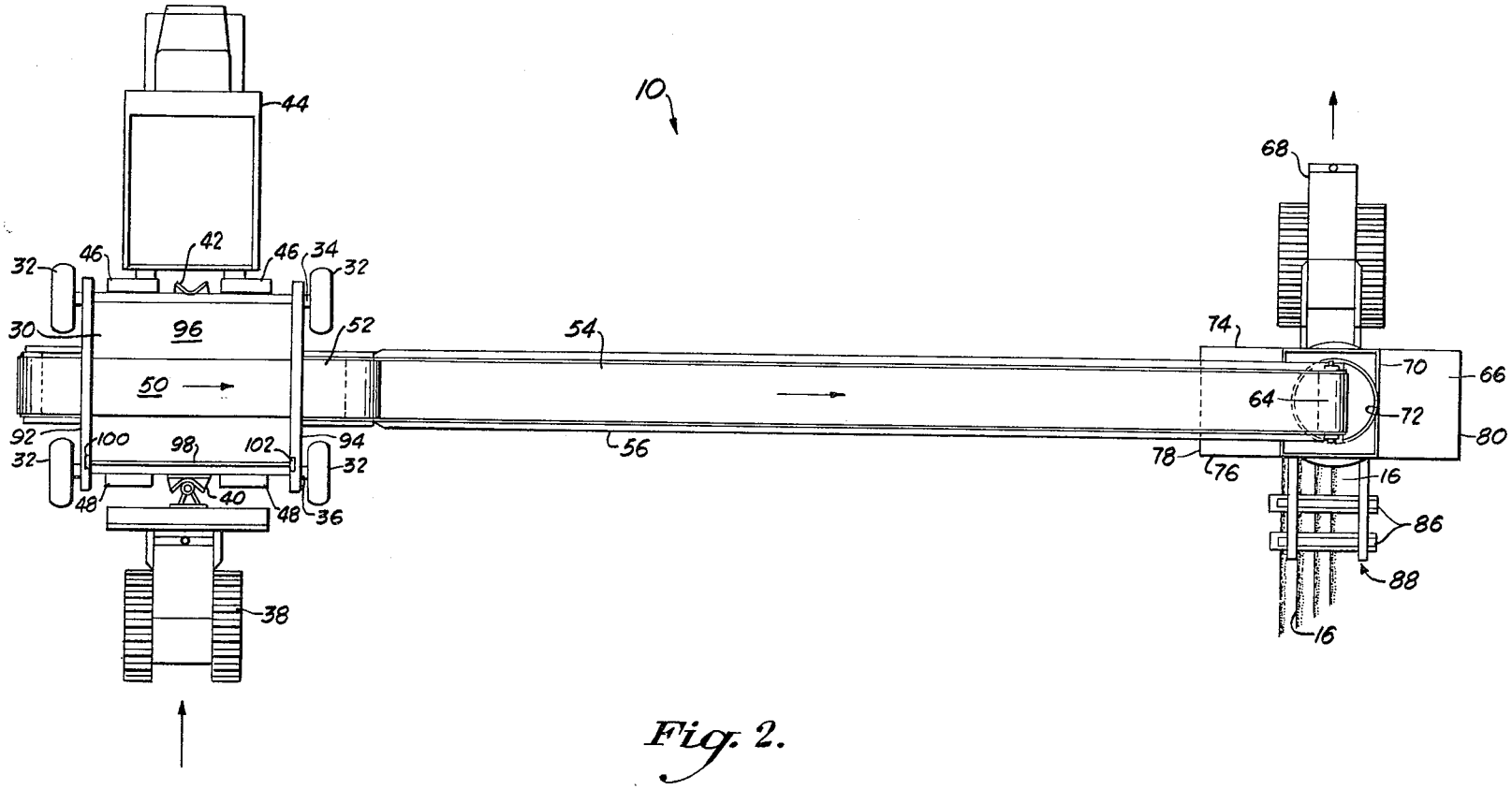
FIG. 2 is an enlarged plan view of the strip paving machine, illustrating the bridge conveyor for transporting castable material from the receiving hopper to the feed hopper as the hoppers are forwardly propelled by suitable prime movers.
Figure 3:
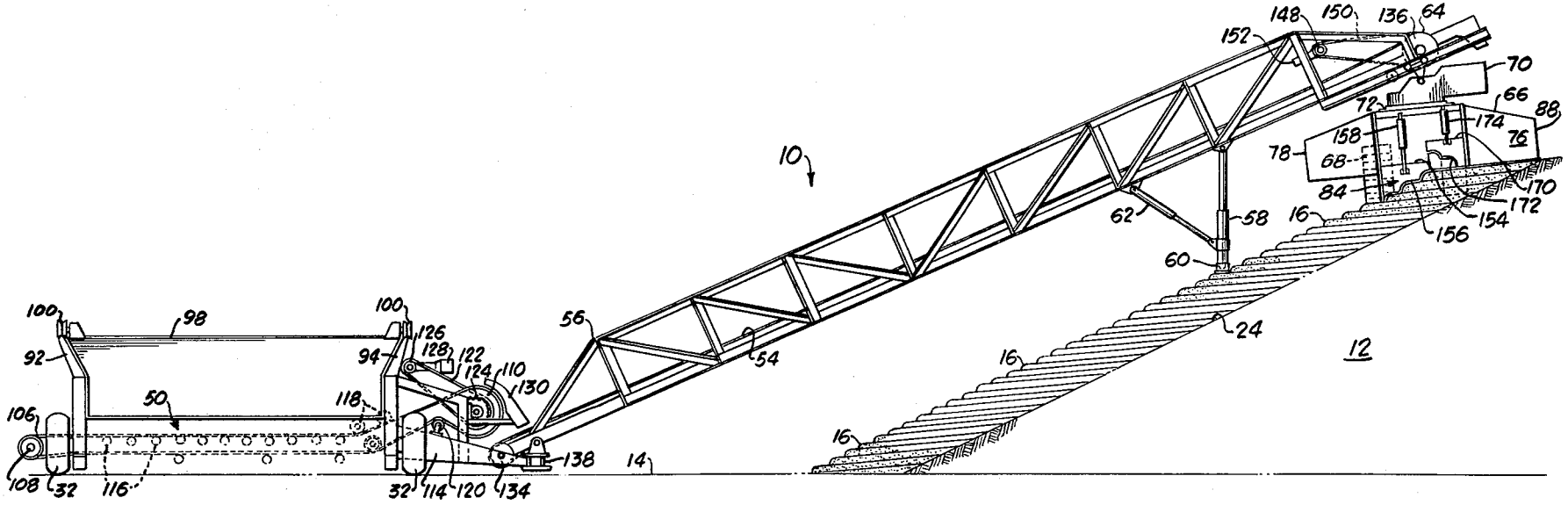
FIG. 3 is a view in side elevation of the strip paving machine shown in FIG. 2, illustrating the end portions of the bridge conveyor support frame pivotally connected to receiving hopper and the feed hopper.

Referring to the drawings and more particularly to FIGs. 1–3, there is illustrated a base strip paving machine generally designated by the numeral 10 for paving the earthen surface of a diversion island 12 for a power plant cooling pond 14 with a series of parallel step-like breakers 16. The cooling pond 14 receives water discharged from a power plant 18 through an outlet 20. The water discharged from the outlet 20 is at an elevated temperature and is directed around the diversion island 12 a sufficient distance so that the temperature of the water is substantially reduced when it returns to the power plant 18 through an inlet 22. The cooling pond 14 divides the outlet 20 from the inlet 22 to thus prevent the heated water from entering the inlet 22.

The diversion island 12 has downwardly sloping walls 24 and 26 constructed primarily of earthen material. The step-like breakers 16 applied to the sloping walls 24 and 26 by the paving machine 10 serve to prevent erosion of the wall. In addition, the breakers 16 serve to break up waves generated within the cooling pond 14. In this manner, hot water is prevented from flowing over the diversion island 12 into the portion of the cooling pond 14 adjacent the inlet 32 and from entering the inlet 22 before being sufficiently cooled. Also, during the construction of the cooling pond 14 and the diversion island 12 the base strip paving machine 10 may be utilized to pave the sidewalls 28 of the cooling pond with step-like surface to minimize erosion of the sidewalls.

As illustrated in FIGS. 2 and 3, the base strip paving machine 10 includes a receiving hopper 30 that is supported by wheels 32 mounted on axles 34 and 36. The receiving hopper 30 is forwardly propelled on the floor of the cooling pond 14 by a suitable prime mover, such as a tractor or bulldozer 38 having a blade that engages a push block 40 of the hopper 30. Another push block 42 is provided on the opposite side of the hopper 30 for engagement with the bulldozer blade when the hopper 30 is propelled in the opposite direction.

As the bulldozer 38 forwardly propels the hopper 30 in a direction parallel to the diversion island 12, forwardly advancing dump truck 42 abutting the front end portion of the hopper 30 continuously deposits the castable material, such as concrete or an admixture of cement and soil into the receiving hopper 30 for paving the sloping walls of the cooling pond 14. Pairs of rollers 46 and 48 are rotatably mounted to the forward and rearward end portions of the hopper 30. As illustrated in FIG. 2, the rear wheels of the dump truck 44 are positioned in abutting relationship with the pair of rollers 46 as the material is continuously deposited into the receiving hopper 30. In this manner, the dump truck 44 remains in material receiving relationship with the hopper 30 as the bulldozer 38 forwardly propels the hopper 30.

The hopper 30 includes a transverse receiving conveyor 50 that receives the material discharged from the dump truck 44. The receiving conveyor 50 includes a discharge end portion 52 that is arranged in overlying relationship with the receiving end portion of a bridge conveyor 54 that is positioned on a conveyor support frame 56. The conveyor support frame 56 is pivotally connected to the receiving hopper 30 and is movable therewith on the floor of the cooling pond 14, in a manner described hereinafter.

The upper end portion of the conveyor support frame 56 includes a hydraulic cylinder 58 having an extensible piston secured to the lower portion of the conveyor support frame. A swivel pad 60 is provided at the base of the hydraulic cylinder and is arranged for slidable movement on the breakers formed by the present invention. A brace member 62 is secured at the end portions thereof to the lower portion of the hydraulic cylinder 58 and the conveyor support frame 56 to maintain vertical positioning of the hydraulic cylinder 58 as the conveyor support frame 56 moves along the diversion island 12. In this manner, the upper end portion of the conveyor support frame 56 may be positioned at a preselected height above the diversion island 12 by adjusting the hydraulic cylinder 58 and the brace member 62.

The bridge conveyor 54 includes a discharge end portion 64 that is arranged in overlying relationship with a feed hopper 66. The feed hopper 66 is secured to and forwardly propelled on the sloping walls of the diversion island 12 by a suitable prime mover, such as the bulldozer 68. The bulldozer 68 propels the feed hopper 66 along the diversion island 12 at the rate of speed that the bulldozer 38 propels the receiving hopper 30 on the floor of the cooling pond 14. In this manner, the bridge conveyor 54 and the conveyor support frame 56, are maintained in a position transverse to the direction of travel of the receiving hopper 30 and the feed hopper 66.

The conveyor support frame 56 is connected at the conveyor discharge end portion 64 to the feed hopper 66 by a funnel 70. The funnel 70 is rotatably supported at its lower end portion upon a turntable 72. The turntable 72 is secured to the upper open end portion of the feed hopper 66. With this arrangement, the funnel 70 is freely rotatable relative to the feed hopper 66 so that when the paving machine 10 has completed a pass on the diversion island 12 to cast a strip of breakers adjacent to a previously cast strip of breakers, the bulldozer 68 may be turned 180 degrees together with the feed hopper 66 for traversing the island 12 in the opposite direction. Thus, as the feed hopper 66 traverses the slope of the diversion island 12, the castable admixture is discharged from the end of the bridge conveyor 54 through the opening in the funnel 70 into the feed hopper 66.

The feed hopper 66 includes a pair of opposed sidewalls 74 and 76 that are positioned parallel to the bridge conveyor 54. Secured to opposite sides of the sidewalls 74 and 76 of the feed hopper 66 are vertical endwalls 78 and 80 arranged to form an open bottom portion 82, illustrated in FIG. 3. A hydraulically actuated extruding device, generally designated by the numeral 84, is secured to the sidewall 76 and overlies an opening in the lower portion of the sidewall 76 to control the flow of the castable admixture from the feed hopper 66. The extruding device 84 has a step-like configuration, as illustrated in FIG. 3, in which three step-like breakers are formed with a single pass of the feed hopper 66 over the inclined slope of the diversion island 12. The extruding device 84 may, however, be constructed to form less than three breakers on the surface of the diversion island 12 in one pass of the feed hopper 66 in accordance with the practice of the present invention.

As the bulldozer 68 advances the feed hopper 66 longitudinally along the last step formed by the previous pass of the feed hopper 66, the castable admixture is continuously deposited onto the sloping wall of the diversion island 12 in the configuration of the extruding device 84. A plurality of vibrating beams 86 are secured rearwardly of the feed hopper 66 by a support frame 88. The support frame 88 is secured to the upper portion of the feed hopper sidewall 76. The vibrating beams 86 have a lower surface with the configuration of the extruding device 84 and are positioned transversely of the strip of breakers formed by the extruding device 84. Suitable motor devices are provided on each of the vibrating beams 86 for reciprocating the beams into and out of contact with the breakers immediately after they are formed by the extruding device 84 to thereby compact the breakers in the desired configuration.

Figure 5:
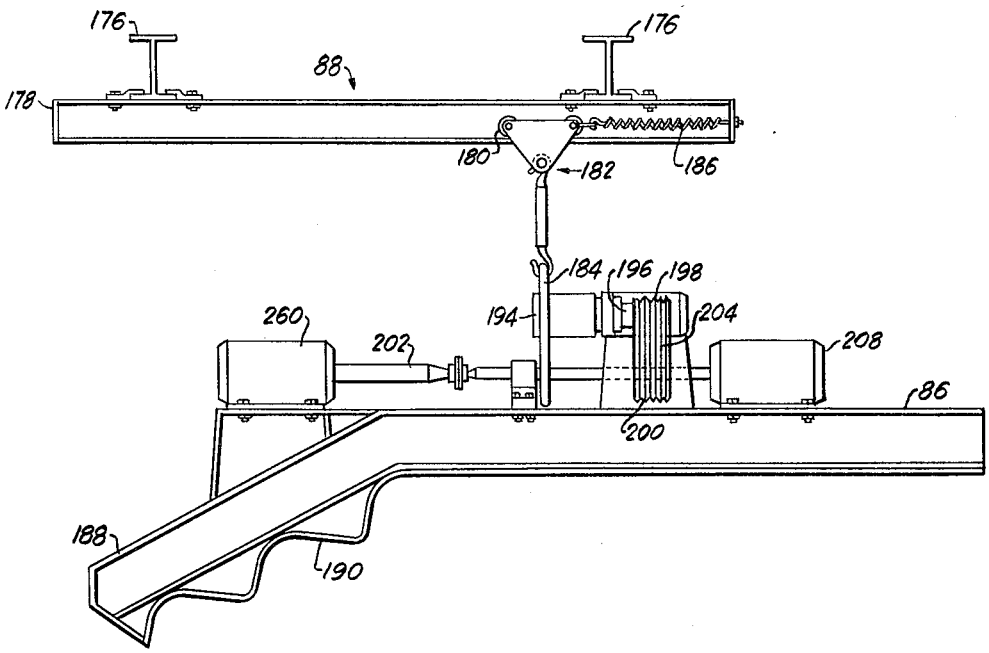
FIG. 5 is a sectional view of one of the vibrating beams taken along the line V—V of FIG. 4.
Figure 6:
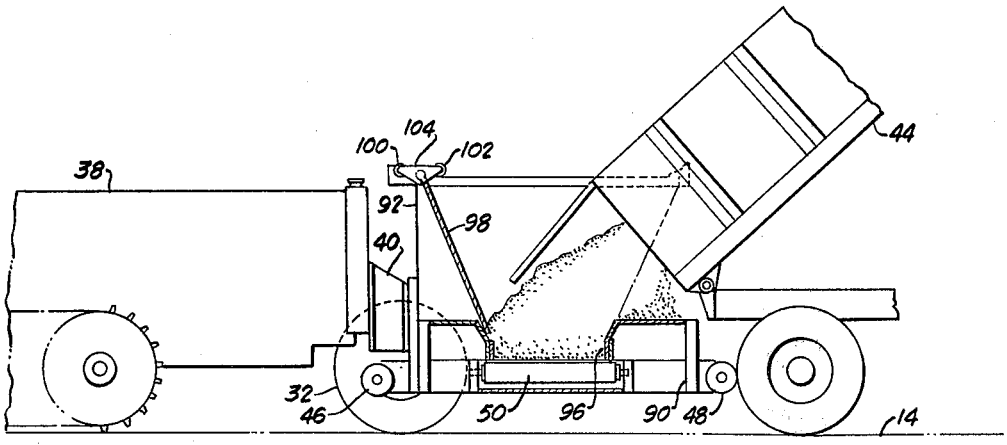
FIG. 6 is a schematic representation in side elevation of the receiving hopper, illustrating the dump truck depositing castable material into the receiving hopper as the bulldozer forwardly propels the receiving hopper.

The receiving hopper 30, as illustrated in FIG. 5 of the drawings, includes a main body portion 90 mounted on and supported by the wheels 32. Secured to the opposite sides of the body portion 90 are vertical side plate members 92 and 94 arranged to form a material receiving bin 96 within which the receiving conveyor 50 is transversely positioned. The end portions of the receiving hopper 30 are open to permit the dump truck 44 to continuously deposit the castable material into the material receiving bin 96 as the bulldozer 38 forwardly propels the receiving hopper 30 along the floor of the cooling pond 14.

To seal the open end portion of the receiving hopper 30 opposite the side from which the dump truck 44 is loading the bin 96, a slidable baffle plate 98 extends transversely between the side plates 92 and 94. The upper end portions of the baffle plate 98 are slidably mounted on the upper edge portions of the side plates 92 and 94 by rollers 100 and 102 that are connected by a hinge member 104 to the baffle plate 98. With this arrangement, the baffle plate 98 is movable between the side plates 92 and 94 to seal the open end portion of the receiving hopper 30 opposite the open end portion into which the castable material is being deposited. Thus, when the paving machine 10 has completed a pass of the diversion island 12 and a subsequent pass of the diversion island 12 is to be made in the opposite direction, the baffle plate 98 is moved from one end portion to the other end portion of the receiving hopper 30.

As illustrated in FIGS. 2 and 3, the receiving conveyor 50 is positioned transversely within the receiving bin 96 of the receiving hopper 30 and comprises an endless flexible belt 106. The belt 106 is reeved at one end portion around a pulley 108 that is rotatably mounted to the body portion 90 outboard of the side plate 92. The other end portion of belt 106 is reeved around a pulley 110 that is rotatably mounted to a frame 112 that is secured to the side plate 94 and a pair of parallel spaced brace members 114 that extend outwardly from the side plate 94. The upper and lower reaches of the conveyor belt 106 supported by rollers 116 and are held in place within the material receiving bin 96 of the receiving hopper 30 by rollers 118. In addition, a tension roller 120 mounted on the brace members 114 is provided to adjust the tension in the conveyor belt 106.

The conveyor belt 106 is rotated in a clockwise direction around the pulleys 108 and 110 by an endless chain 122. The endless chain 122 passes over around sprocket 124 that is coaxially mounted with the pulley 110 to the support frame 112 and sprocket 126 that is rotatably supported to the upper portion of the support frame 112. The endless chain 122 is driven by a hydraulic motor 128 that receives fluid under pressure from the bulldozer 38. A chute 130 is secured to the support frame 112 and is positioned tangentially relative to the conveyor belt 106 passing around the pulley 110. With this arrangement, as the receiving hopper 30 continuously receives the castable material from the dump truck 44, the receiving conveyor 50 transports the material from the material receiving bin 96 through the chute 130 onto the receiving end portion of the bridge conveyor 54.

Figure 4:
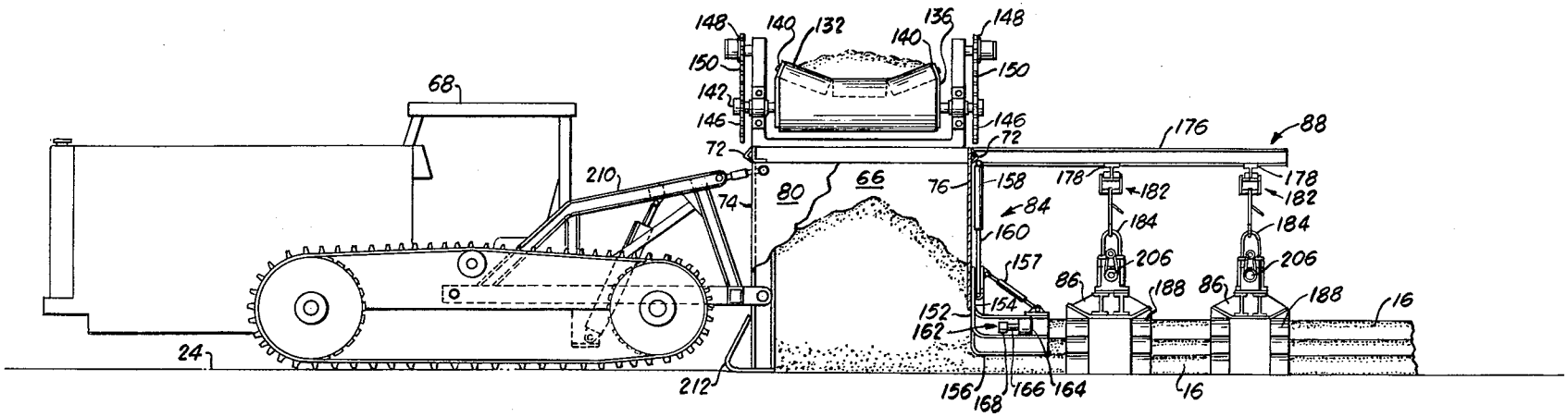
FIG. 4 is an end view partially in section of the feed hopper, illustrating a tractor for propelling the feed hopper as the castable material is fed through an extruding device to form step-like breakers on the surface of the diversion island with vibrating beams for compacting the formed breakers.

The bridge conveyor 54, as illustrated in FIG. 3, comprises an endless conveyor belt 132 that is rotatably supported at one end portion to a first pulley 134 that is rotatably secured to the conveyor support frame 56 in underlying relationship with the pulley 110 of the receiving conveyor 50. The other end portion of the conveyor belt 132 is supported by a pulley 136 that is rotatably supported to the conveyor support frame 56 at the discharge end portion 64 of the bridge conveyor 54 in overlying relationship with the feed hopper 66 (as illustrated in FIG. 4). As illustrated in FIG. 3, the brace member pairs 114 include a turntable mechanism 138 that is slidable over the floor of the cooling pond 14 as the bulldozer 38 forwardly propels the receiving hopper 30. The end portion of the conveyor support frame 56 is connected to the turntable 138 to permit independent pivotal movement of the conveyor support frame 56 relative to the brace member pairs 114. Furthermore, the pivotal connections of the end portion of the conveyor support frame 56 to the brace member pairs 114 serves to maintain the conveyor belt 132 axially aligned with the receiving conveyor 50.

The conveyor support frame 56, as hereinabove described, is movably supported on the formed breakers of the diversion island 12 by the hydraulic cylinder 58 and the brace member 62. As the breaker strips are progressively cast upon the inclined walls of the diversion island 12 from the floor of the cooling pond upward, the hydraulic cylinder is also advanced up the slope as the breakers are formed. Upon completion of the laying of a strip of breakers, the hydraulic cylinder 58 is actuated to raise the swivel pad 60 from contact with the surface of the breakers so that the swivel pad 60 may be moved to a higher position on the diversion island 12. The swivel pad 60 is returned to contact with the breakers by downwardly extending the piston rod of the hydraulic cylinder 58.

As illustrated in FIG. 4, the upper reach of the belt conveyor 132 passes over rollers 140 that support the upper conveyor reach in a concave configuration to define a trough for confining the castable material on the conveyor belt 132 as it is transported from the receiving hopper 30 to the feed hopper 66. The pulley 136 is nonrotatably secured to a shaft 142 mounted in bearings 144. The sprockets 146 are nonrotatably secured to the end portions of the shaft 142. The sprockets 146 are drivingly connected to sprockets 148 by a chain 150. The sprockets 148 are driven by a hydraulic motor 152, illustrated in FIG. 3, that is mounted to the conveyor support frame 56. Hydraulic fluid under pressure is supplied to the motor 152 from the bulldozer 68 by a conduit (not shown). With this arrangement, the bridge conveyor belt 132 is rotated in a clockwise direction to transport the castable material from the receiving hopper 30 to the feed hopper 66 through the funnel 70.

Referring to FIG. 4, the castable material discharged from the bridge conveyor end portion 64 and through the funnel 70 is deposited on the surface of the diversion island 12 within the feed hopper 66. The lower end portion of the side wall 76 of the feed hopper 66 is spaced from the surface of the diversion island 12 to thereby provide an opening 152 that is partially obstructed by the extruding device 84. The extruding device 84 includes a first vertical plate member 154 having a flanged lower end portion 156 having a desired configuration for forming the breakers. A brace member 157 connected to plate member 154 is provided for supporting the flanged portion 156. As above discussed, the breakers are formed in a step-like configuration. To this end, the flanged portion 156 has a lower surface with the configuration to form three step-like breakers with a single pass of the paving machine across the diversion island 12.

The plate member 154 of the extruding device 84 abuts the side wall 76 and is vertically movable relative thereto by a hydraulic cylinder 158 having an extensible piston 160 that is secured to the plate member 154. The upper end portion of the hydraulic cylinder 158 is secured to the feed hopper side wall 76. Actuation of the hydraulic cylinder 158 downwardly extends the piston 160 to thereby obstruct a portion of the opening 152 with the shaped flanged portion 156. With this arrangement, the castable material is discharged through the opening 152 and is cast by the extruding device 84 to form the step-like breakers on the surface of the diversion island 12 as the feed hopper is forwardly propelled by the bulldozer 68.

The shaped flange portion 156 of the extruding device 84 is provided with a vibrating unit 162 to aid in the feeding of the castable material from the hopper 66. The vibrating unit 162 includes a hydraulic motor 164 that receives fluid under pressure from the bulldozer 68 for rotating a shaft 166 drivingly connected thereto. Unbalancing weights 168 are nonrotatably connected to the end portion of the shaft 166 and rest on the flanged portion 156. Actuation of the motor 164 rotates the shaft 166 to, in turn, rotate the unbalancing weights 168 to vibrate the flanged portion 156 at a high frequency.

The extruding device 84 also includes a second plate member 170, having a lower shaped flanged portion 172 similar to that of the plate member 164 and the shaped flange portion 156. The plate member 170 is also secured to the side wall 76 by a piston cylinder assembly 174. As illustrated in FIG. 3, when either one of the plate members 154 or 170 are utilized to shape the breakers on the diversion island 12, the other one of the plate members is retained in retracted position.

Therefore, upon completion of casting a strip of breakers on the diversion island 12, the vertical plate member 154 would be retracted and the plate member 170 extended when the feed hopper 66 is rotated 180 degrees for traversing the slope of the diversion island in the opposite direction to form a subsequent strip of breakers.

The breakers formed by the extruding device 84 are compacted by the vibrating beams 86 that are positioned rearwardly of the feed hopper 66 on the support frame 88. The support frame 88, as illustrated in FIGS. 4 and 5, includes a pair of parallel spaced beam members 176 that are secured at one end portion to the feed hopper 66. Secured below and positioned transversely relative to the beam members 176 are the beam members 178. Rollers 180 are positioned on the lower horizontal surface of each of the beam members 178. A hoist mechanism 182 is secured to the rollers 180 at one end portion and the other end portion is connected to a bale 184 that is secured to each of the vibrating beams 86. An adjustable spring 186 is secured at one end to each of the beams 178 and at the other end to the rollers 180 of the hoist mechanisms 182. The springs 186 maintain the vibrating beams at a preselected location below the beam members 178. In this manner, the vibrating beam 86 are maintained in alignment with the extruding device 84 of the feed hopper 66.

Each of the vibrating beams 86 includes a downwardly depending end portion 188 having a lower surface 190 with the configuration of the breakers formed by the extruding device 84. As, for example, as illustrated in FIGS. 4 and 5, the lower surface 190 has a step-like configuration for compacting the breakers that are formed by the extruding device 84. A vibrating mechanism 192 is supported on the upper surface of each of the beam members 86 for reciprocating the beam members 86 into and out of contact with the formed breakers to thereby compact the breakers in the desired configuration.

The vibrating mechanism 192 includes a hydraulic motor 194 that is nonrotatably connected to a shaft 196 for rotating a pulley 198. A pulley 200 is connected to pulley 198 by belts 204 and is nonrotatably supported by a shaft 202. The shaft 202 is symmetrically positioned above each of the beam members 86 and is supported at one end portion within the bearing housing 206. The other end portion of the shaft 202 is connected to a vibrator 208 that is bolted to the beam member 86. Fluid under pressure is supplied from the bulldozer 68 through a conduit (not shown) to actuate the motor 194 and rotate the shaft 196. Rotation of shaft 196 is transmitted by pulley 198 through the belts 204 to rotate pulley 200 and shaft 202. Rotation of the shaft 202 actuates the vibrator 208 to, in turn, vibrate the beam 86 at high frequency and thereby move the shaped lower surface 190 into and out of contact with the cast breakers. In this manner, the breakers are compacted after they are cast by the extruding device 84.

The casting of the step-like breakers on the sloping walls 24 and 26 of the diversion island 12 is accomplished by the bulldozer 38 pushing the receiving hopper 30 at the rate of speed the bulldozer 68 pulls the feed hopper 66. Suitable signal devices are provided in the operator's compartment of both bulldozers 38 and 68 so that the bulldozers may be propelled at a rate of speed which maintains the receiving hopper 30 in a side by side relationship with the feed hopper 66 with the receiving conveyor 50 and the bridge conveyor 54 axially aligned.

The bulldozer 68 pulls the feed hopper 66 along the slope of the diversion island 12. The bulldozer 68, as illustrated in FIG. 4, includes hydraulically actuated boom arms 210 that are pivotally connected to the sidewall 74 of the feed hopper 30. The lower portion of the sidewall 74 includes a skid 212 that slides along the surface of the diversion island. When the paving machine 10 has advanced the length of the diversion island 12 to lay a strip of breakers thereon, the dump truck 44 and the bulldozer 38 reverse their position relative to the receiving hopper 30 for advancing the paving machine 10 in the opposite direction. In addition, the boom arms 210 of the bulldozer 68 are actuated to sufficiently raise the bottom of the feed hopper 66 from the surface of the diversion island to permit the bulldozer to rotate the feed hopper 180° on the turntable mechanism 138. In this manner, the paving machine 10 is positioned for advancement in the opposite direction on the diversion island 12 to form a subsequent strip of breakers adjacent the last formed step of the previous strip. As hereinabove explained, the selected one of the extruding device plate members 154 or 170 is moved into position to continue casting a strip of breakers that corresponds with the last formed strip of breakers. Thus, the paving machine 10 is progressively traversed back and forth along the sloping walls 24 and 26 of the diversion island 12 to completely pave the surfaces thereof with the step-like breakers.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A paving machine for paving a sloped surface with a castable material in strips having a preselected configuration comprising, a mobile receiving hopper for continuously receiving the castable material, first prime mover means positioned in abutting relation with said receiving hopper for forwardly propelling said receiving hopper, said receiving hopper having an adjustable outlet for discharging the castable material at a controlled rate as said receiving hopper is forwardly propelled, conveyor means for transporting the castable material laterally from said receiving hopper, said conveyor means having a receiving end portion positioned in material receiving relation with said receiving hopper outlet and a discharge end portion positioned laterally of said receiving hopper, frame means pivotally connected at one end portion to said receiving hopper and extending laterally relative to said receiving hopper with said conveyor means positioned on said frame means, said frame means being movably supported on the sloped surface and positioned at the other end portion at a preselected height above the sloped surface, a feed hopper secured to and positioned below said conveyor discharge end portion for receiving the castable material from said conveyor means, extruding means positioned in the lower portion of said feed hopper above the sloped surface for spreading the castable material onto the sloped surface in accordance with a preselected form, vibrating means secured to the rearward end portion of said feed hopper for compacting the formed castable material, and second prime mover means connected to said feed hopper for forwardly propelling said feed hopper on the sloped surface with said conveyor means being positioned on said frame means transverse to the direction of travel of said receiving hopper and said feed hopper.

2. A paving machine for paving a sloped surface with a castable material in strips having a preselected configuration as set forth in claim 1 which includes, means positioned on said frame means for pivotally connecting said receiving hopper to said conveyor receiving end portion.

3. A paving machine for paving a sloped surface with a castable material in strips having a preselected configuration as set forth in claim 2 in which said means for pivotally connecting said receiving hopper to conveyor means receiving end portion includes, a pair of ground engaging brace members extending outwardly from and below said receiving hopper outlet, said frame means having one end portion pivotally connected to said brace members with said conveyor means receiving end portion positioned in underlying relationship with said outlet to receive the castable material therefrom.

4. A paving machine for paving a sloped surface with a castable material in strips having a preselected configuration as set forth in claim 1 which includes, means connected to said frame means and rotatably supported on said feed hopper for connecting said feed hopper to said conveyor discharge end portion so that said feed hopper is arranged to rotate relative to said conveyor for traversing movement on the sloped surface.

5. A paving machine for paving a sloped surface with a castable material in strips having a preselected configuration as set forth in claim 4 in which said means for connecting said feed hopper to said conveyor discharge end portion includes, a funnel secured to said conveyor supporting means in material receiving relationship with said conveyor discharge end portion, and means supported by said feed hopper for rotatably supporting said funnel to permit rotation of said feed hopper relative to said conveyor supporting means on the sloped surface.

6. A paving machine for paving a sloped surface with a castable material in strips having a preselected configuration as set forth in claim 1 in which said feed hopper includes, a pair of opposed sidewalls parallel to said conveyor means, a front endwall connected to said sidewalls and having a lower open end portion, a rear endwall connected to said sidewalls and having means for securing said rear endwall to said second prime mover means, said sidewalls and said front and rear endwalls forming an open bottom portion of said feed hopper, and said extruding means secured to said front endwall and including means for feeding the castable material from said feed hopper open bottom portion.

7. A paving machine for paving a sloped surface with a castable material in strips having a preselected configuration as set forth in claim 6 in which said extruding means includes, a plate member positioned on said front endwall for vertical reciprocal movement, said plate member having a shaped lower portion for casting the castable material in a preselected configuration, piston cylinder means secured to said front endwall and having an extensible piston rod secured to said plate member for raising and lowering said plate member relative to said front endwall lower open end portion, said plate member arranged to assume a first position retracted above said lower open end portion and a second position extended below said lower open end portion such that the castable material is fed from said feed hopper onto the sloped surface and is cast by said plate member shaped lower portion in a strip having a preselected configuration.

8. A paving machine for paving a sloped surface with a castable material in strips having a preselected configuration as set forth in claim 7 in which said feeding means includes, a vibrating mechanism secured to plate member and operable to vibrate said plate member and feed the castable material from said feed hopper as said feed hopper is being forwardly propelled by said second prime mover means.

9. A paving machine for paving a sloped surface with a castable material in strips having a preselected configuration as set forth in claim 6 in which said feeding means includes, a vibrating mechanism secured to said extruding means and operable to vibrate said extruding means at a preselected frequency and thereby feed the castable material from said feed hopper as said feed hopper is being forwardly propelled by said second prime mover means.

10. A paving machine for paving a sloped surface with a castable material in strips having a preselected configuration as set forth in claim 1 in which said mobile receiving hopper includes, a body portion mounted on wheels, a pair of parallel spaced vertical side plates secured to said body portion to form a material receiving bin having open end portions, a conveyor transversely positioned in said material receiving bin for transporting the castable material from said receiving hopper onto said conveyor means, said conveyor having a material discharge end portion positioned in overlying relationship with said conveyor means material receiving end portion, and means for selectively sealing said material receiving bin open end portions.

11. A paving machine for paving a sloped surface with a castable material in strips having a preselected configuration as set forth in claim 10 in which means for selectively sealing said material receiving bin open end portions includes, a baffle plate extending between said spaced vertical side plates, roller means for slidably supporting the upper end portions of said baffle plate on the upper edge portions of said vertical side plates, said baffle plate movable between the material receiving bin open end portions to seal one open end portion opposite the other open end portion receiving the castable material to confine the castable material in said material receiving bin.

12. A paving machine for paving a sloped surface with a castable material in strips having a preselected configuration as set forth in claim 1 in which said vibrating means includes, a plurality of parallel spaced beam members supported rearwardly of said feed hopper adjacent said extruding means, said beam members positioned transversely relative to the strips cast by said extruding means and each of said beams having an end portion with a shaped lower surface having the configuration of the extruding means, and motor driven means mounted on each of said beam members for vibrating said beam members to urge said shaped lower surfaces into and out of contact with the strips to compact the strips cast by said extruding means.

* * * * *